US005960484A

United States Patent [19]

Shao

[11] Patent Number: 5,960,484

[45] Date of Patent: Oct. 5, 1999

[54] TOILET DEVICE FOR CLEANING ONESELF AFTER EVACUATION OF BOWELS

[76] Inventor: Kuang Hua Shao, 79 Ming Sun Rd., Changhua, Taiwan

[21] Appl. No.: 09/118,885

[22] Filed: Jul. 20, 1998

[51] Int. Cl.[6] ..... A47K 3/20

[52] U.S. Cl. ..... 4/420.4; 4/447; 4/448

[58] Field of Search ..... 4/420.4, 447, 448, 4/443, 444, 445, 446, 420.1, 420.2, 420.3

[56] References Cited

U.S. PATENT DOCUMENTS

| | | | |
|---|---|---|---|
| 4,069,519 | 1/1978 | Alexander | 4/7 |
| 4,334,329 | 6/1982 | Miyanaga | 4/443 |
| 4,953,238 | 9/1990 | Shifferly | 4/420.2 |

*Primary Examiner*—Henry J. Recla
*Assistant Examiner*—Huyen Le
*Attorney, Agent, or Firm*—Bacon & Thomas

[57] ABSTRACT

A toilet device is fastened with a toilet seat for cleaning automatically oneself after evacuation of the bowels. The toilet device is composed of a base, a crank fastened pivotally with the base, and a handle fastened with the crank. The base is fastened with the inner side of the rear end of the toilet seat and is provided with a slide cover and a water emitting tube which is slidably fitted into the slide cover. When the handle is activated, the crank is actuated to drive the water emitting tube to extend such that the water emitting holes of the water emitting tube are positioned to clean the anus of a person seated on the toilet seat.

5 Claims, 14 Drawing Sheets

TOILET DEVICE FOR CLEANING ONESELF AFTER EVACUATION OF BOWELS

FIELD OF THE INVENTION

The present invention relates generally to a flush toilet, and more particularly to a toilet device attached to the flush toilet for use in cleaning oneself after evacuation of the bowels.

BACKGROUND OF THE INVENTION

The conventional flush toilet is generally provide with a roll of toilet paper for use in cleaning oneself after evacuation of the bowels. The use of the toilet paper can often result in a sensation of strong discomfort or pain for a person suffering from hemorrhoids. As a result, a new electronically-controlled toilet was introduced to meet the need of those who suffer from the anal disorders. The electronically-controlled toilet is defective in design in that it is rather complicated in construction, and that it carries a high price tag, and further that it is rather cumbersome, and still further that it is not equipped to flush the cold water out before it is used to clean the user thereof after the evacuation of the bowels.

SUMMARY OF THE INVENTION

The primary objective of the present invention is to provide a toilet device for cleaning oneself after evacuation of the bowels. The toilet device of the present invention is relatively simple in construction, easy to use, and inexpensive. In addition, the toilet device of the present invention is equipped to flush the cold water out before it is used to clean the users thereof after the evacuation of the bowels.

The objective, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
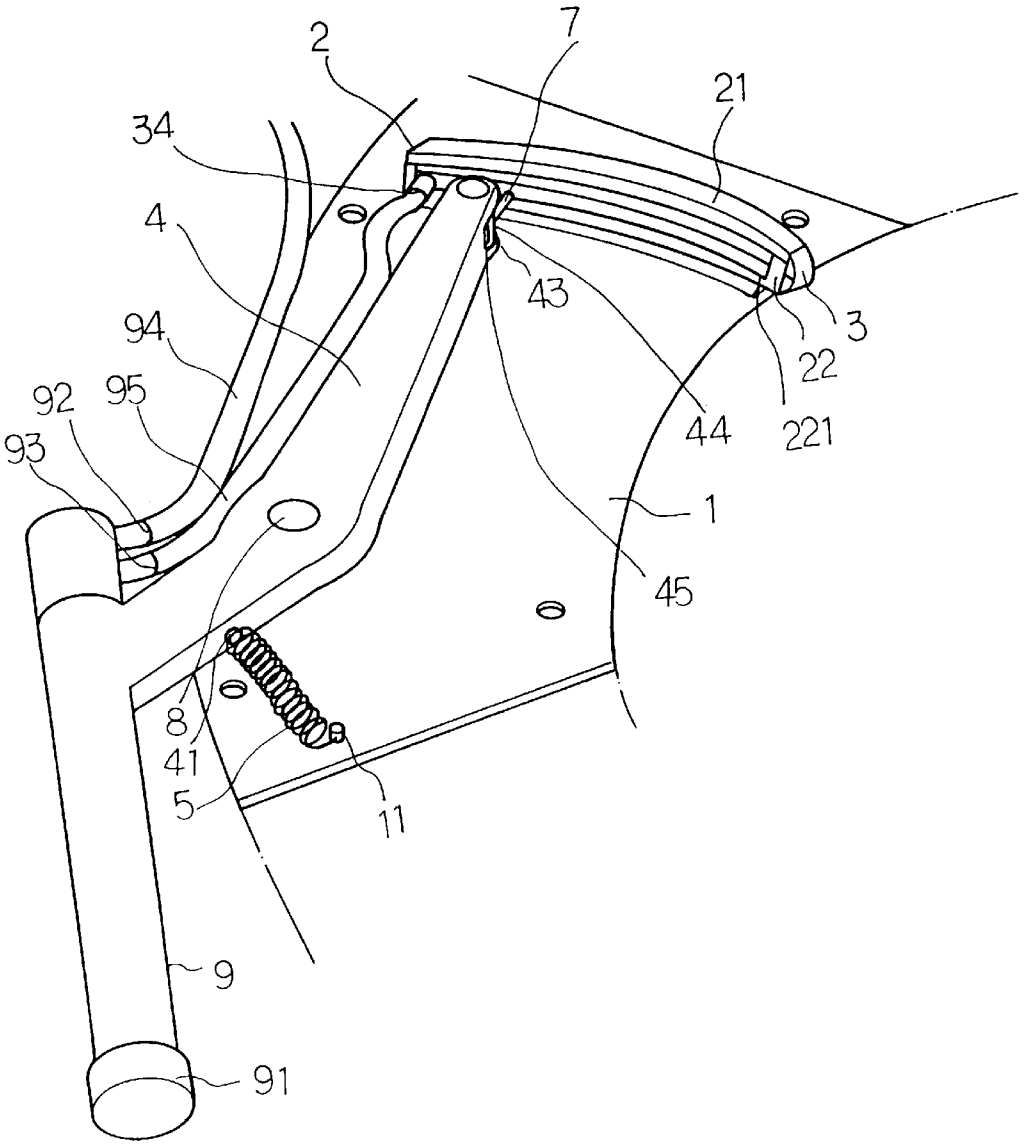
FIG. 1 shows a schematic view of the present invention.

As shown in FIGS. 1–4, a toilet device embodied in the present invention is intended for use in cleaning oneself after evacuation of the bowels and is composed of a base 1, a slide cover 2 of an arcuate construction, a water emitting tube 3 of an arcuate construction, a crank 4, and a spring 5.

The base 1 is fastened to the inner side of the rear end of a toilet seat 6, and is provided with a protrusion 11.

The slide cover 2 is formed of an upper cover 21 and a lower cover 22 which is connected with the base 1 and is provided with an arcuate opening 221.

The water emitting tube 3 is movably disposed in the slide cover 2 such that the water emitting tube 3 is capable of moving in an arcuate path. The water emitting tube 3 is formed of an upper frame piece 31 and a lower frame piece 32 and is provided at one end thereof with a solid body 33 having a horizontal threaded hole 331 engageable with a threaded segment 71 of a fastening rod 7. The solid body 33 is provided with a water inlet 34. The solid body 33 has a head end which is provided with a plurality of water emitting holes 35.

Figure 7:
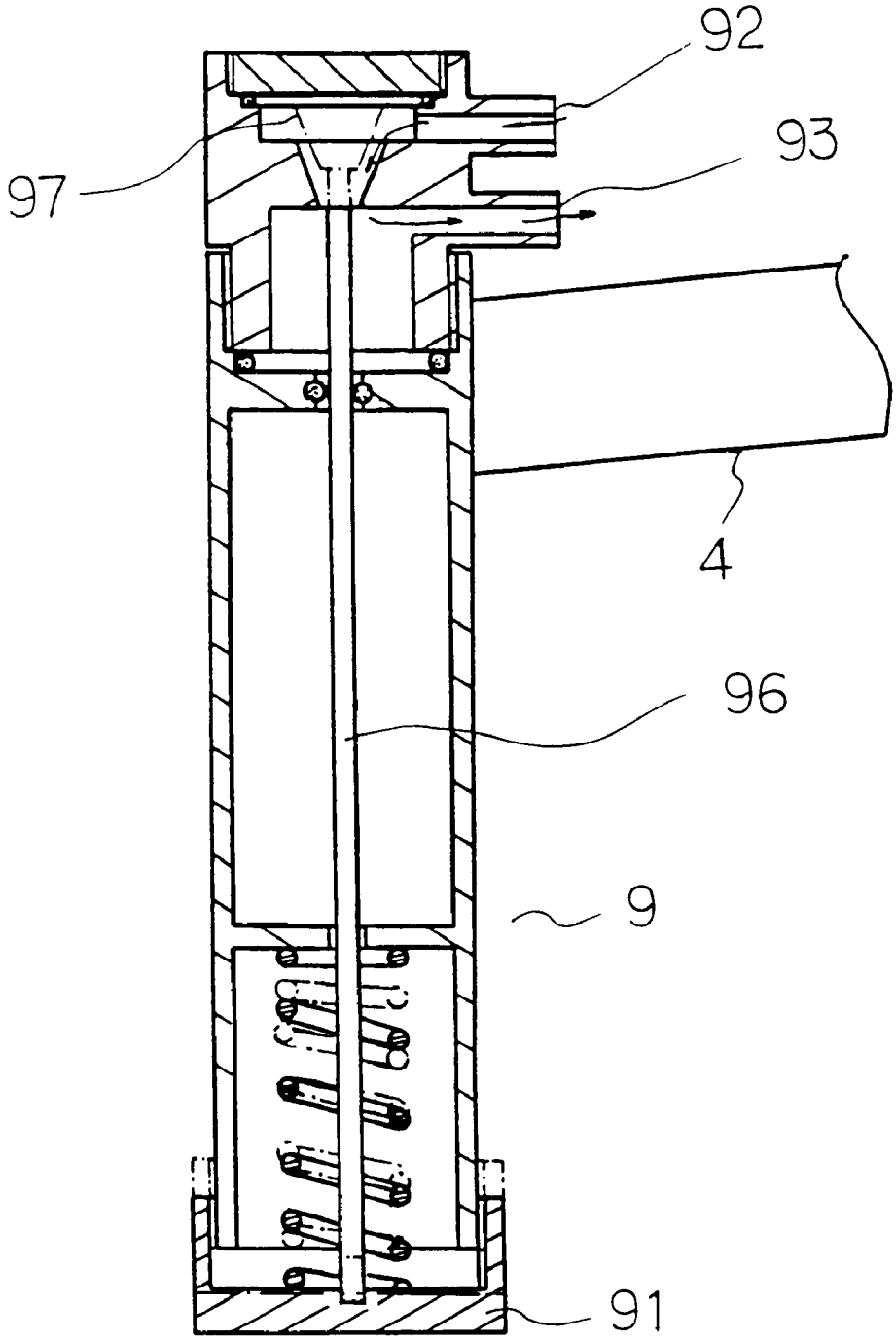
FIG. 7 shows a sectional schematic view of a handle of the present invention at work.
Figure 8:
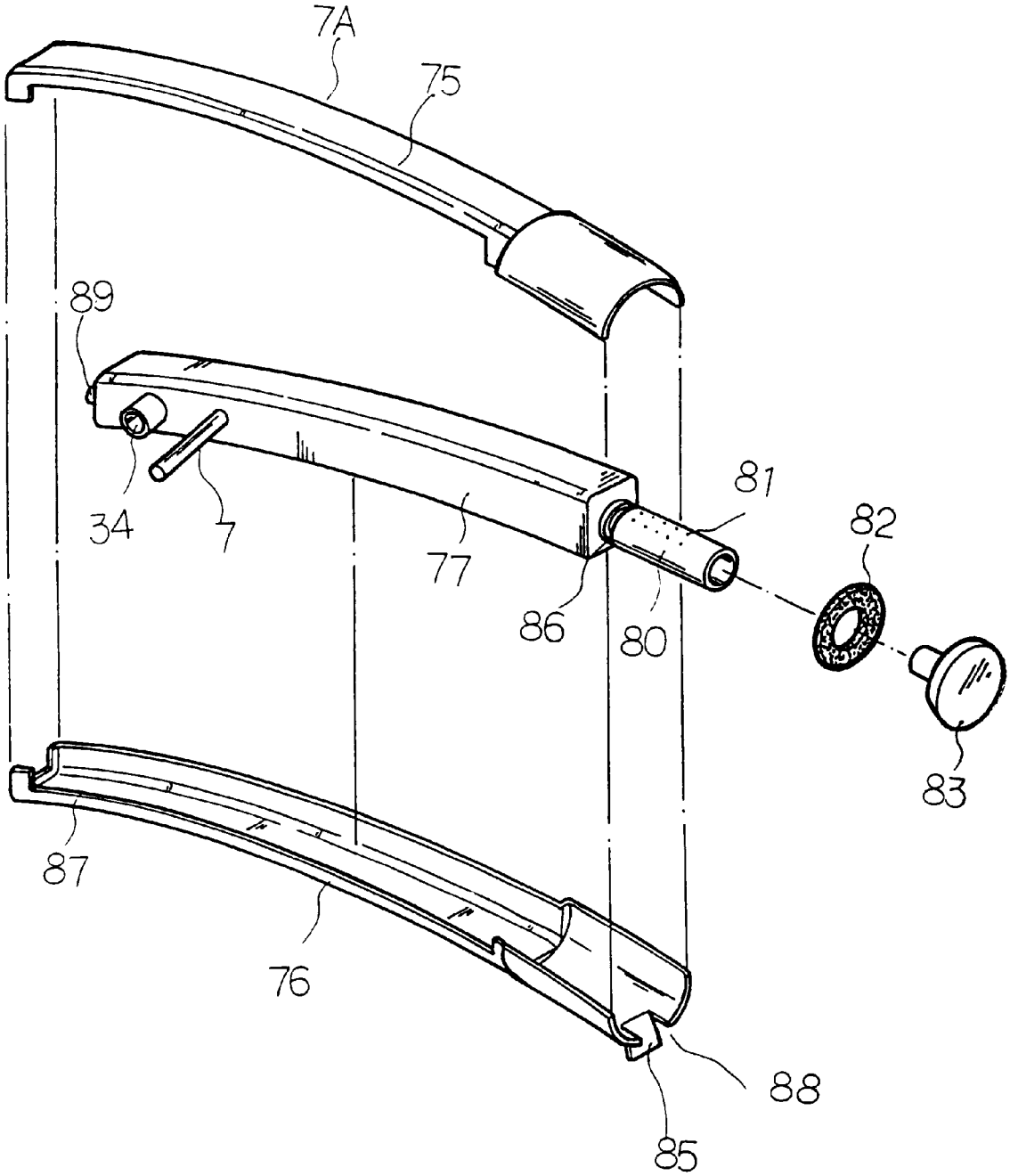
FIG. 8 shows a schematic view of the arcuate slide cover and the arcuate water-ejecting tube of the present invention in combination.
Figure 9:
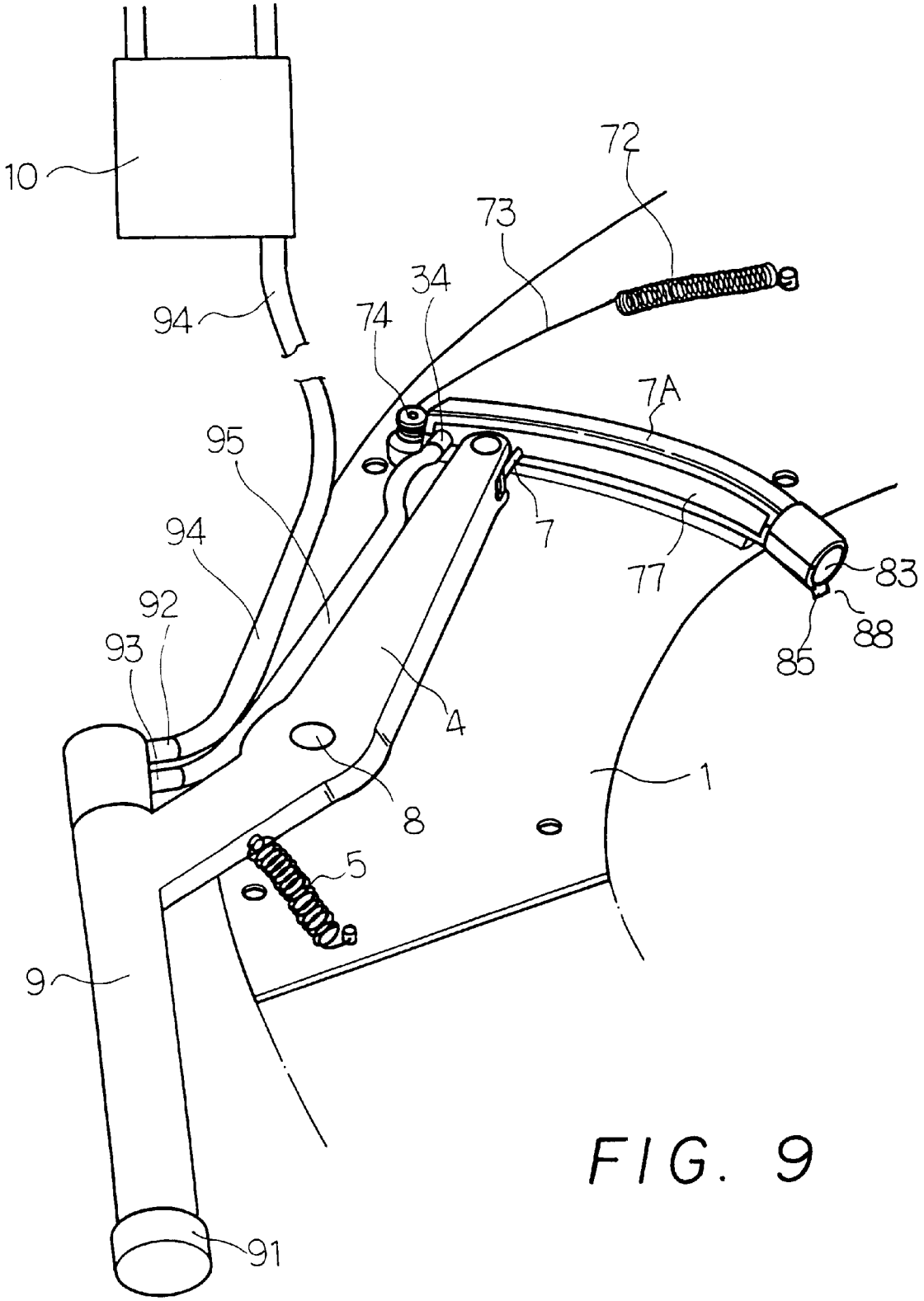
FIG. 9 is a schematic view showing the retraction of the arcuate water ejecting tube into the arcuate slide cover of the present invention.
Figure 10:
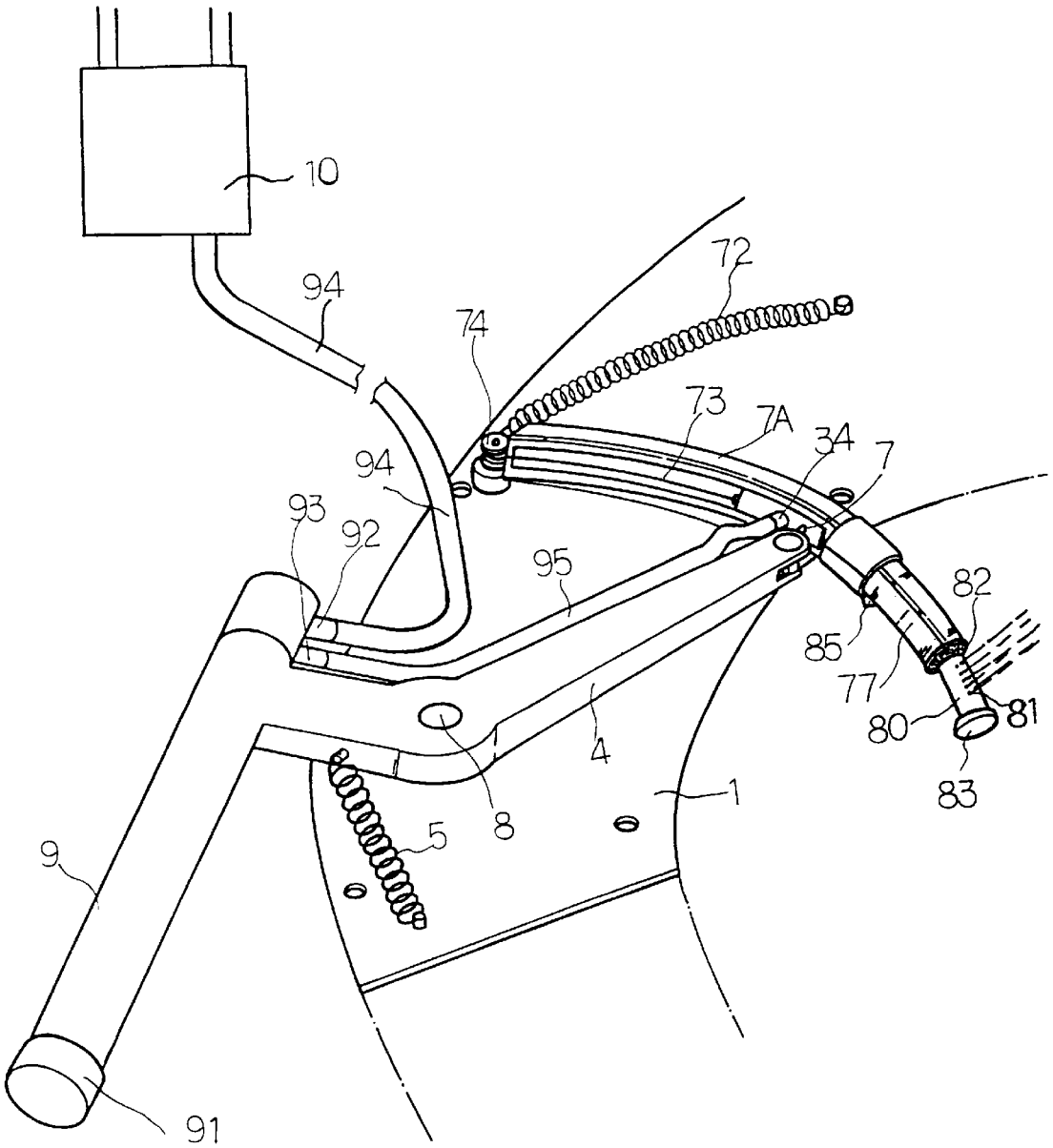
FIG. 10 shows a schematic view of the extracted water ejecting tube of the present invention.

The crank 4 is fastened pivotally with a pivoting column 8 such that the crank 4 is fastened with a handle 9, as shown in FIG. 7. The handle 9 is provided at one end thereof with a water switch 91, and at other end thereof with a water inlet 92 and a water outlet 93, which are respectively connected with a water admitting tube 94 and a water discharging tube 95 which is in turn connected at other end thereof with the water inlet 34 of the water emitting tube 3. The water admission and the water discharge are regulated by a tapered body 97 of a switching rod 96 connected with the water switch 91. The crank 4 is provided with a hooked portion 41 connected with the protrusion 11 of the base 1 by the spring 5. The crank 4 is further provided with a recess 43 and a rotary slide column 44 which is disposed in the recess 43 and is provided with an oblong slot 45 for receiving the fastening rod 7.

Figure 2:
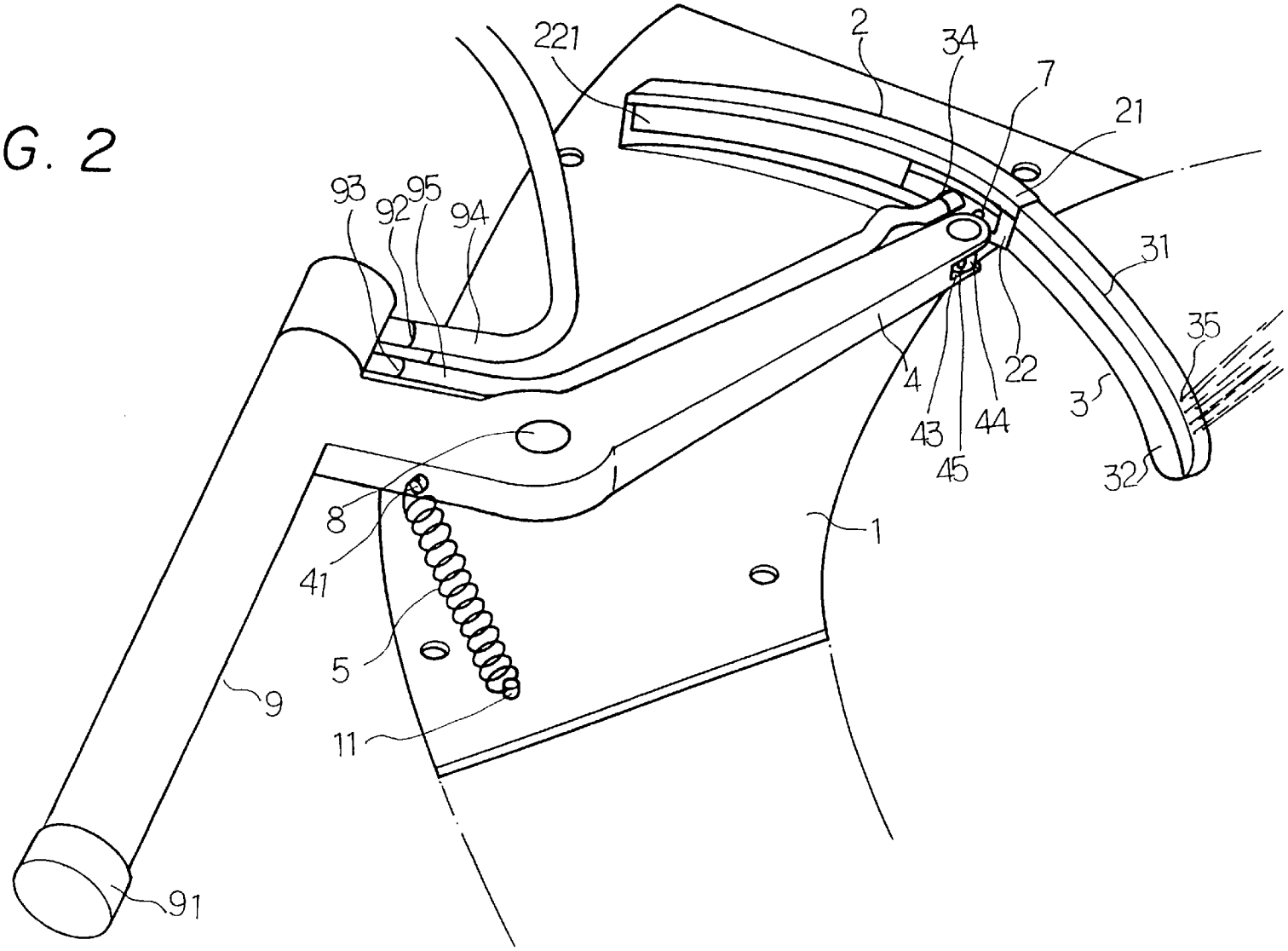
FIG. 2 shows a schematic view of the present invention at work.
Figure 3:
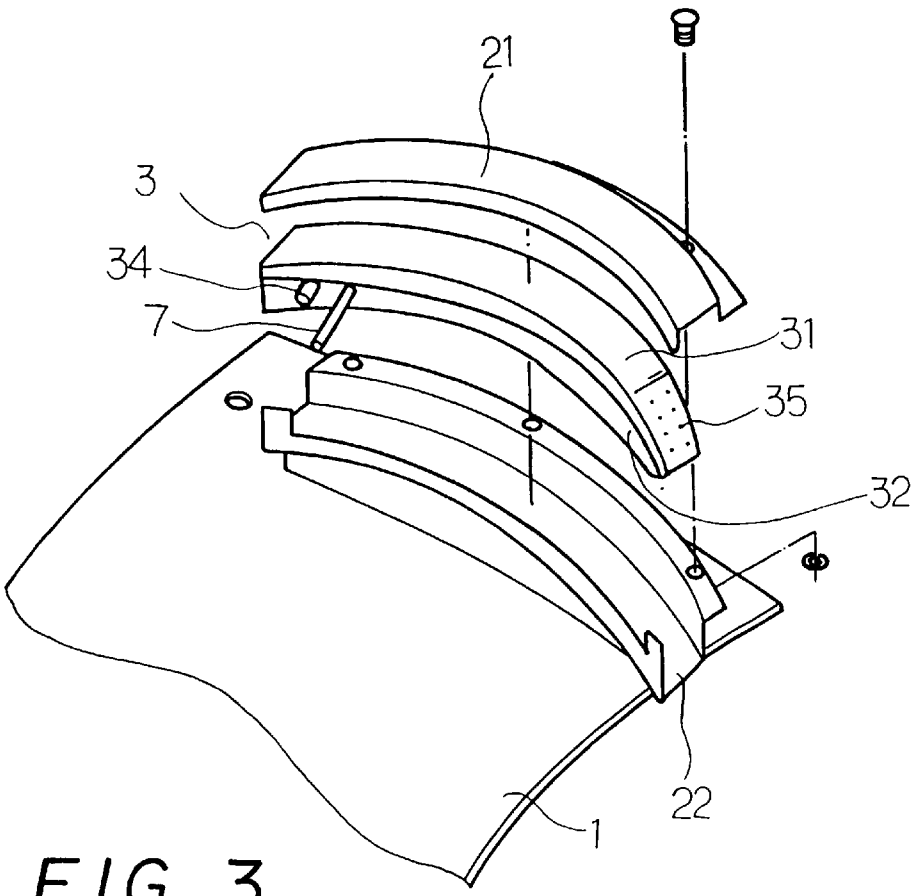
FIG. 3 shows an exploded view of an arcuate slide cover and an arcuate water-ejecting tube of the present invention.
Figure 4:
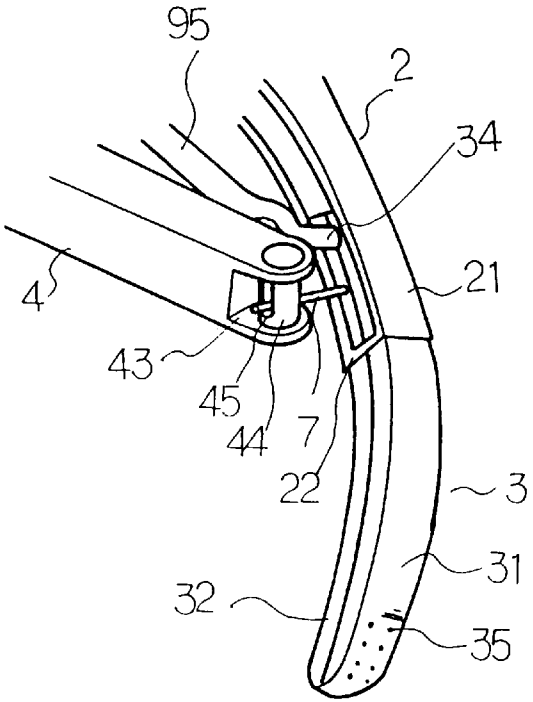
FIG. 4 shows a partial schematic view of the present invention.
Figure 5:
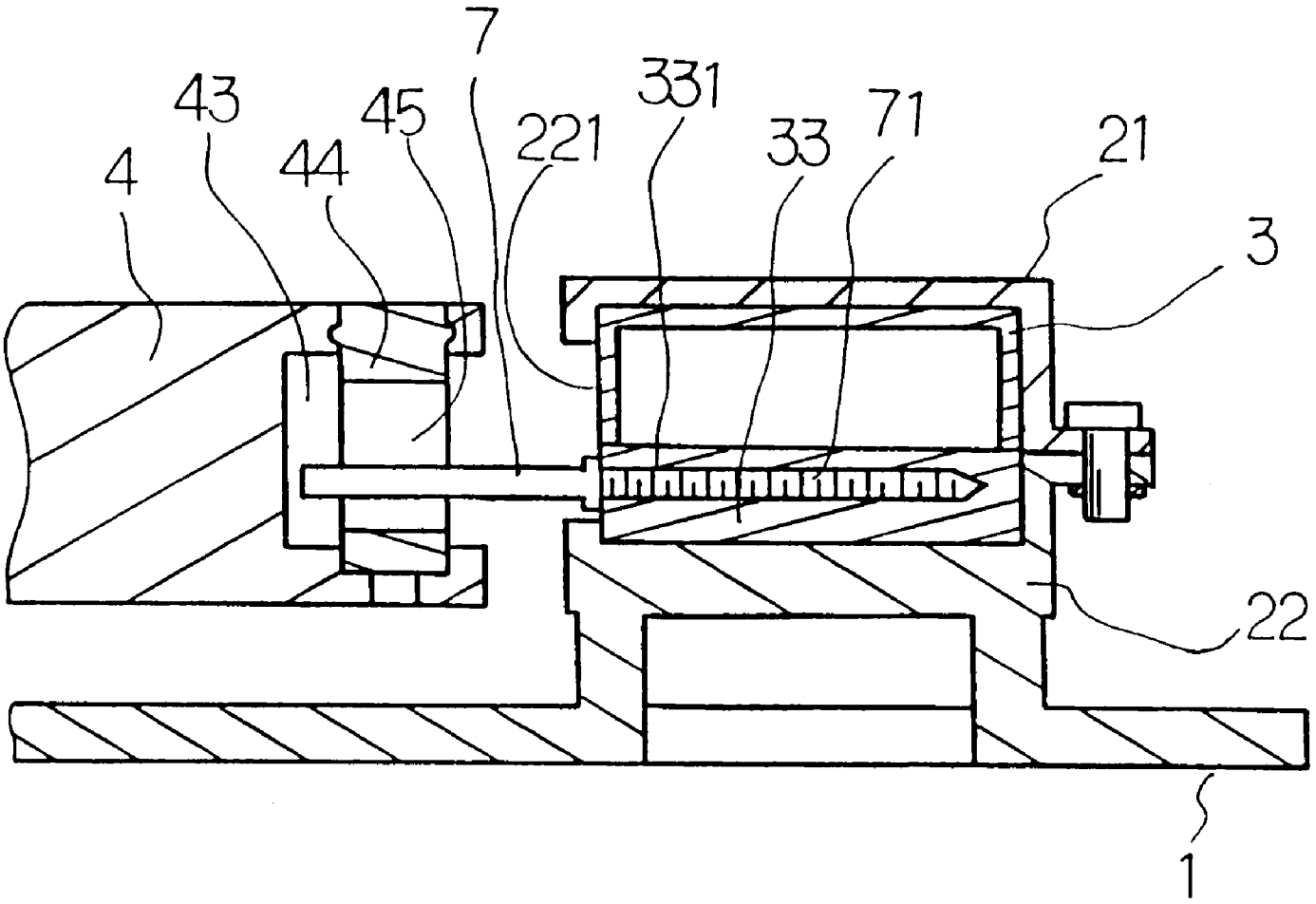
FIG. 5 is a partial sectional view of the present invention.
Figure 6:
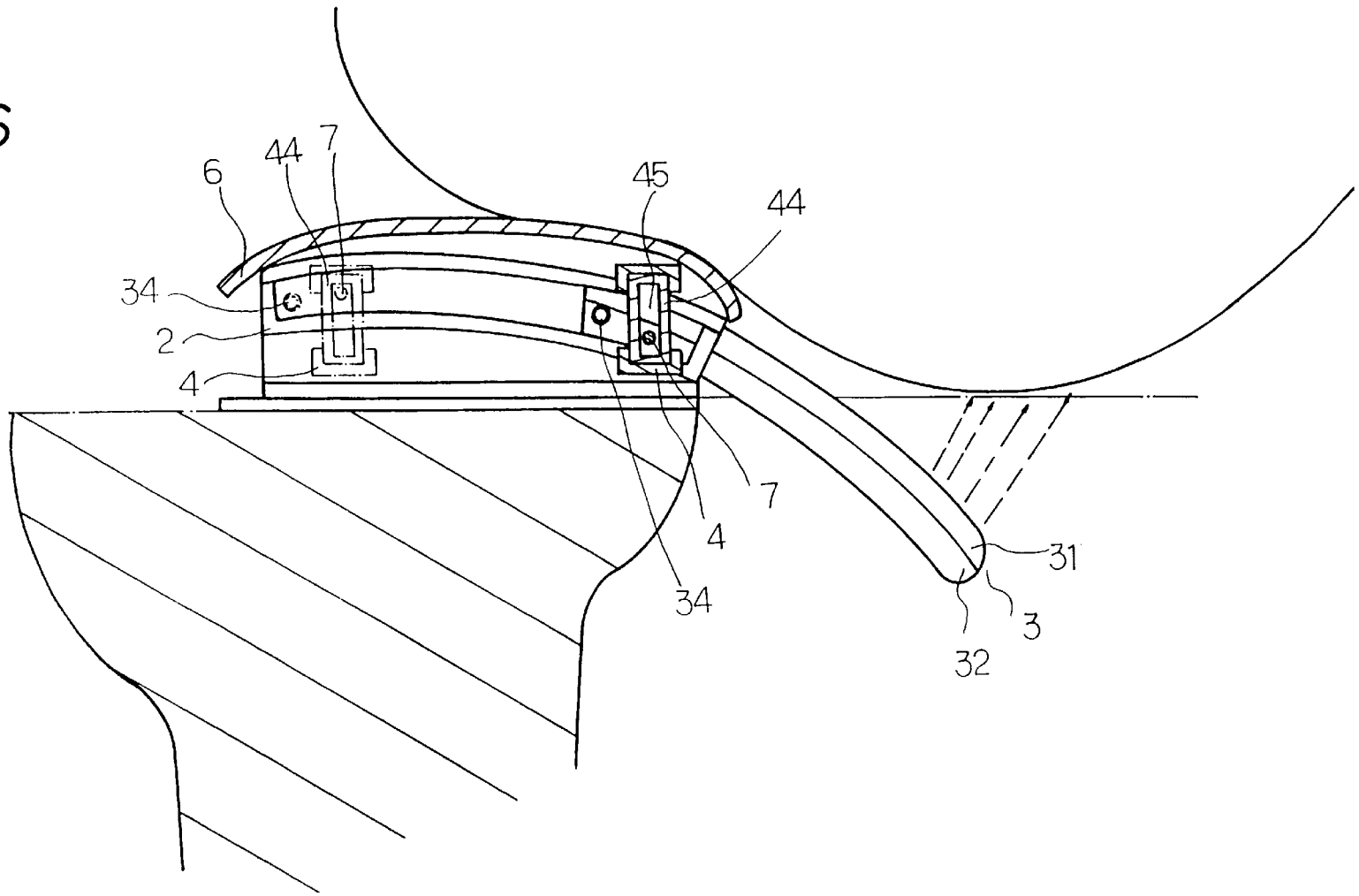
FIG. 6 is a sectional view illustrating the operation of the present invention.

In operation, the handle 9 is swung horizontally and outwardly to actuate the crank 4 such that the rotary slide column 44 of the crank 4 actuates the fastening rod 7 which is disposed in the oblong slot 45. As a result, the rotary slide column 44 is capable of turning, whereas the fastening rod 7 is capable of moving along the oblong slot 45 so as to actuate the water emitting tube 3 to extend along the radian of the arcuate slide cover 2, as shown in FIGS. 2, 6, and 7. As the water emitting tube 3 is properly positioned, the water switch 91 is pressed to emit the water via the water emitting holes 35 for cleaning the anus. As soon as the water switch 91 is relieved of the pressure exerting thereon, the emission of water via the water emitting holes 35 is brought to a halt. In the meantime, the crank 4 is forced by the spring 5 to return to its original position as shown in FIG. 1.

As shown in FIGS. 8–15, the embodiment of the present invention described above can be modified such that the arcuate slide cover 7A is provided at one end thereof with a pulley 74, and in one side thereof with a tension spring 72 which is fastened at one end thereof with a pull cord 73 of the water emitting tube 77. The water emitting tube 77 can be thus force back to its original position with ease and speed, thanks to the tension spring 72.

The front end of the arcuate slide cover 7A may be of a cylindrical construction and provided with a water discharging port 88 and a stop piece 85 contiguous to the water discharging port 88. The stop piece 85 is used to control the direction in which the water is discharged.

The water emitting tube 77 is provided with a water emitting portion 80 having a circular groove 86 for locating a washer 82 capable of averting the return of water. The water emitting portion 80 is provided with a sealing head 83 and a connection head 89 for connecting a pull cord 73.

Figure 11:
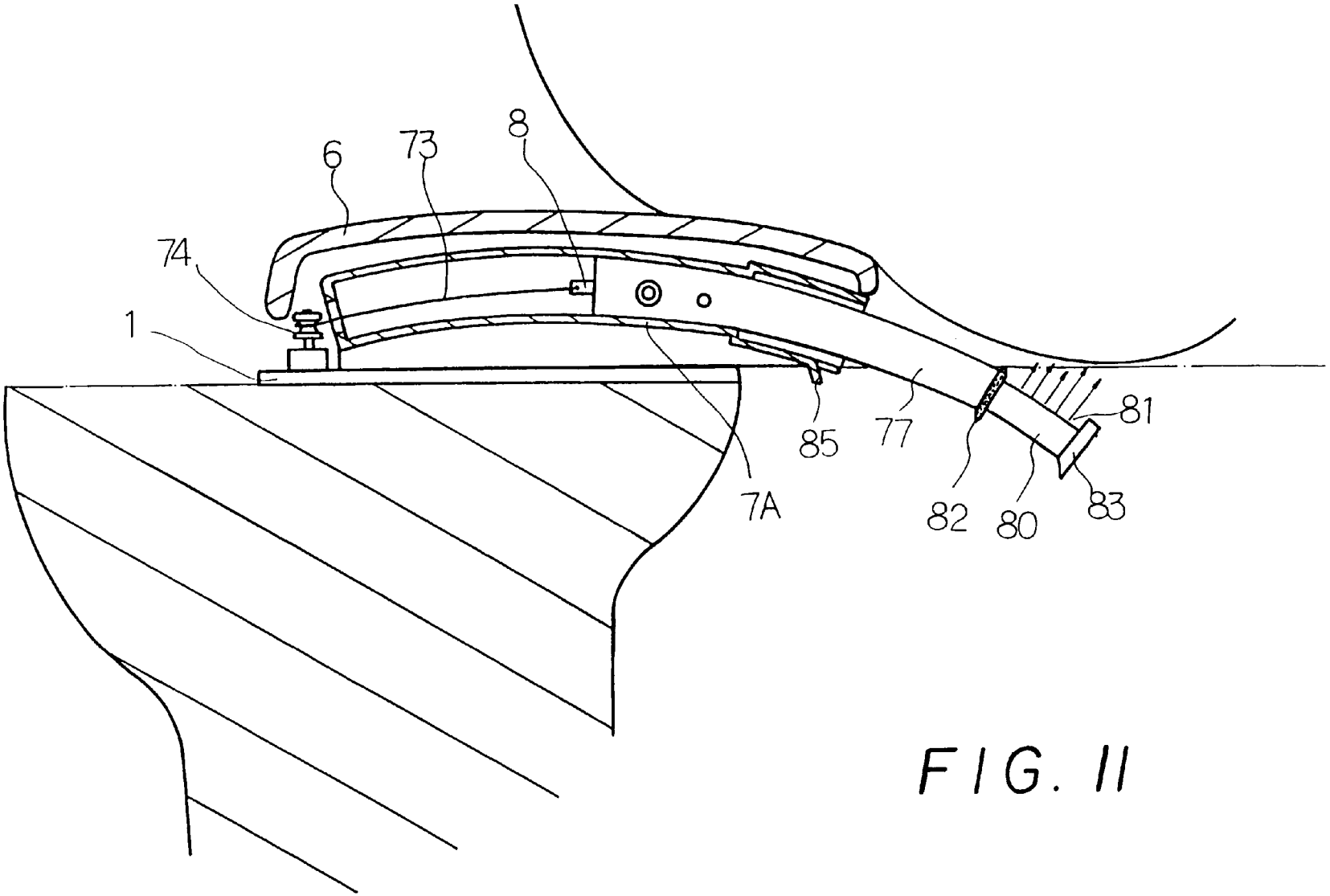
FIG. 11 is a sectional schematic view of the present invention capable of flushing out the cold water before the present invention is used for cleaning oneself after evacuation of the bowels.
Figure 12:
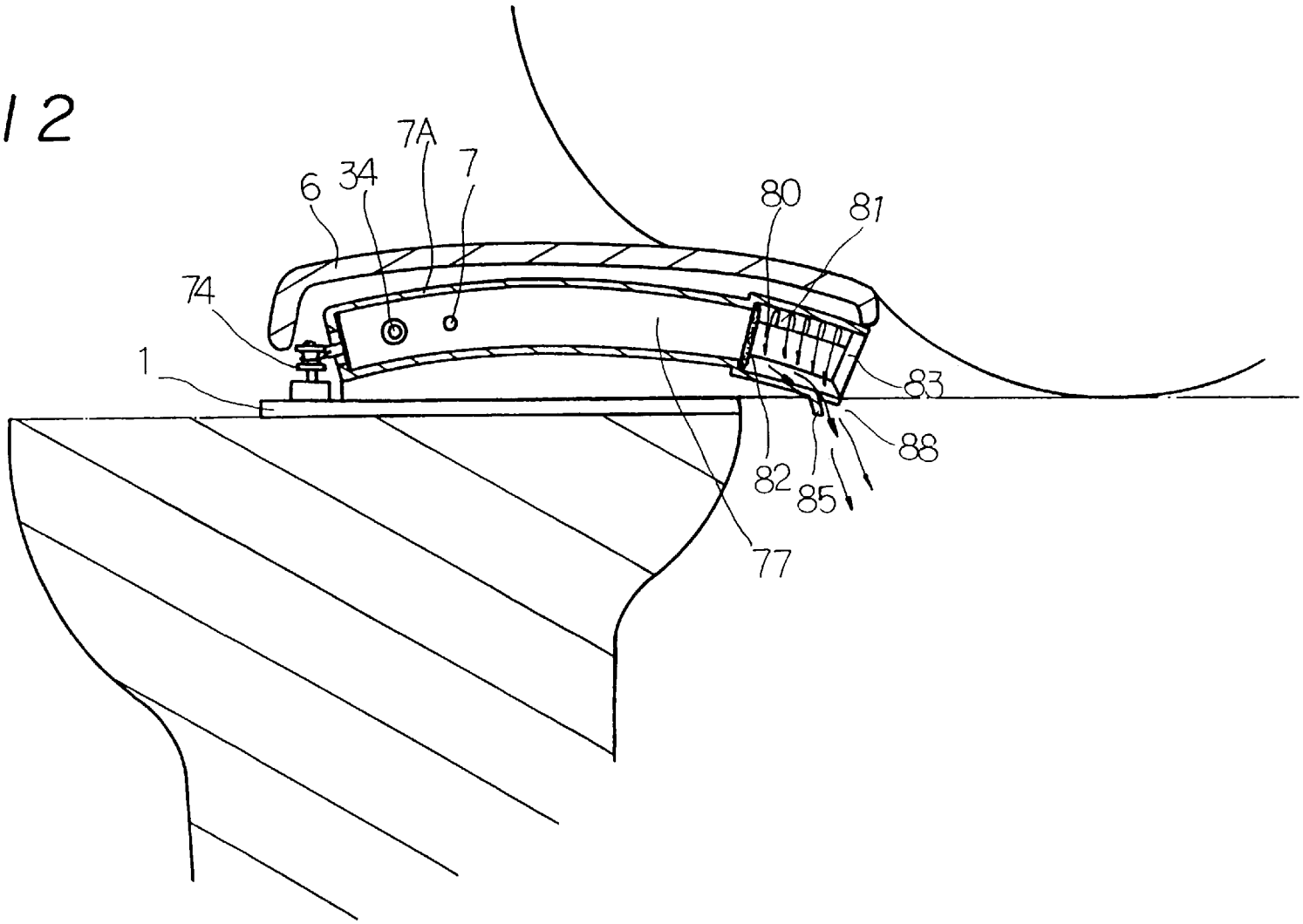
FIG. 12 shows another schematic view of the extracted water ejecting tube of the present invention.
Figure 13:
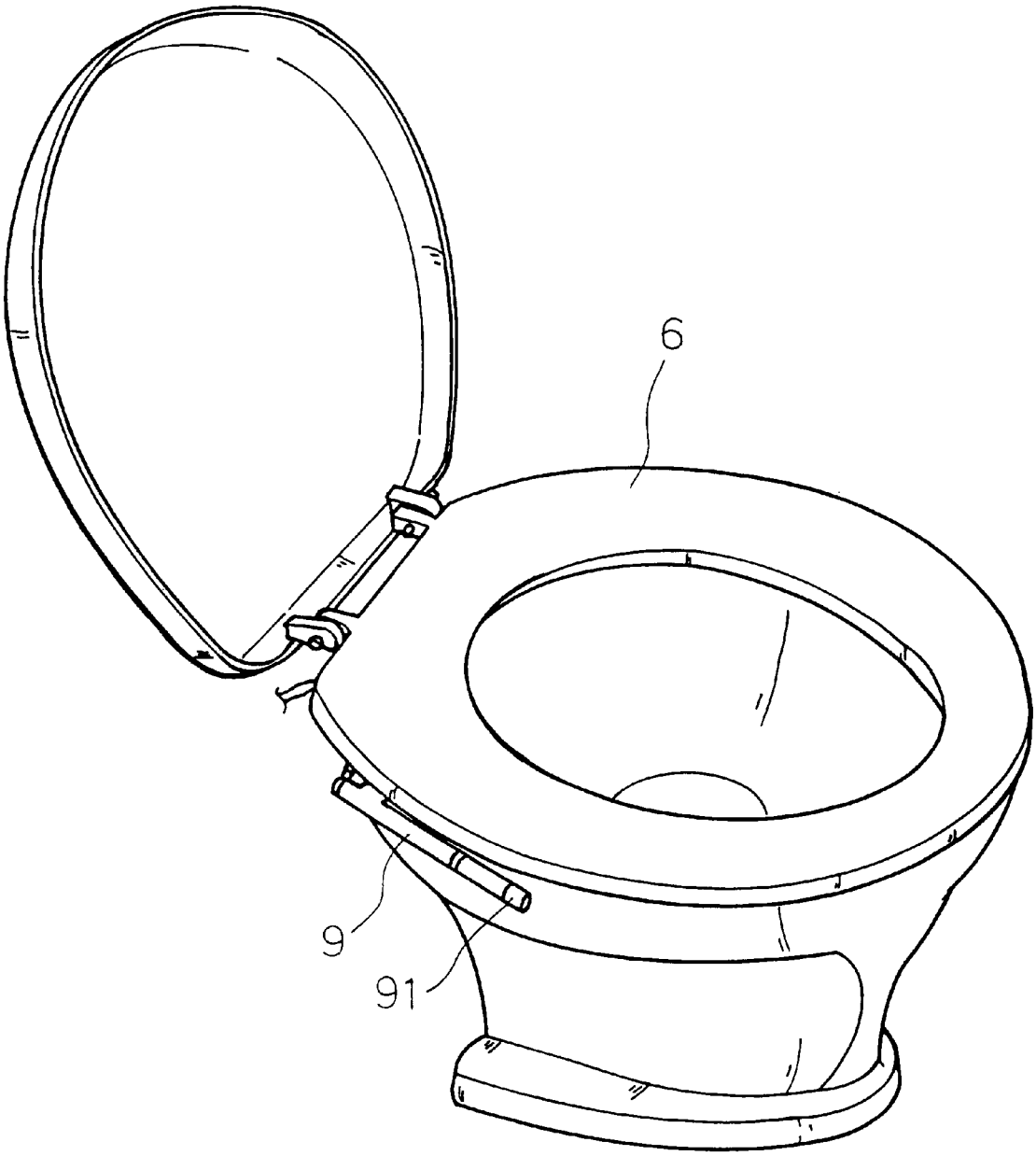
FIG. 13 shows a perspective view of a flush toilet that is equipped with the device of the present invention.

In operation, the water switch 91 of the handle 9 is pressed to allow the cold water in the water admitting tube 94, the water discharging tube 95 and the water emitting tube 77 to be drained out, as shown in FIG. 11. The water emitting tube 77 is still kept in the slide cover 7A in view of the fact that the crank 4 has not been actuated by the handle 9. The cold water is finally discharged into the toilet bowl via the water discharging port 88. The direction in which the water is discharged is controlled by the stop piece 85. A few seconds after the discharge of the cold water, the handle 9 is triggered to actuate the crank 4 such that the water emitting tube 77 is forced to extend out of the slide cover 7A, as shown in FIG. 12, to be ready to emit the warm for cleaning the anus of a person who has finished the evacuation of the bowels. The water emitting tube 77 is capable of returning to its original position, thanks to the springs 5 and 72.

Figure 14:
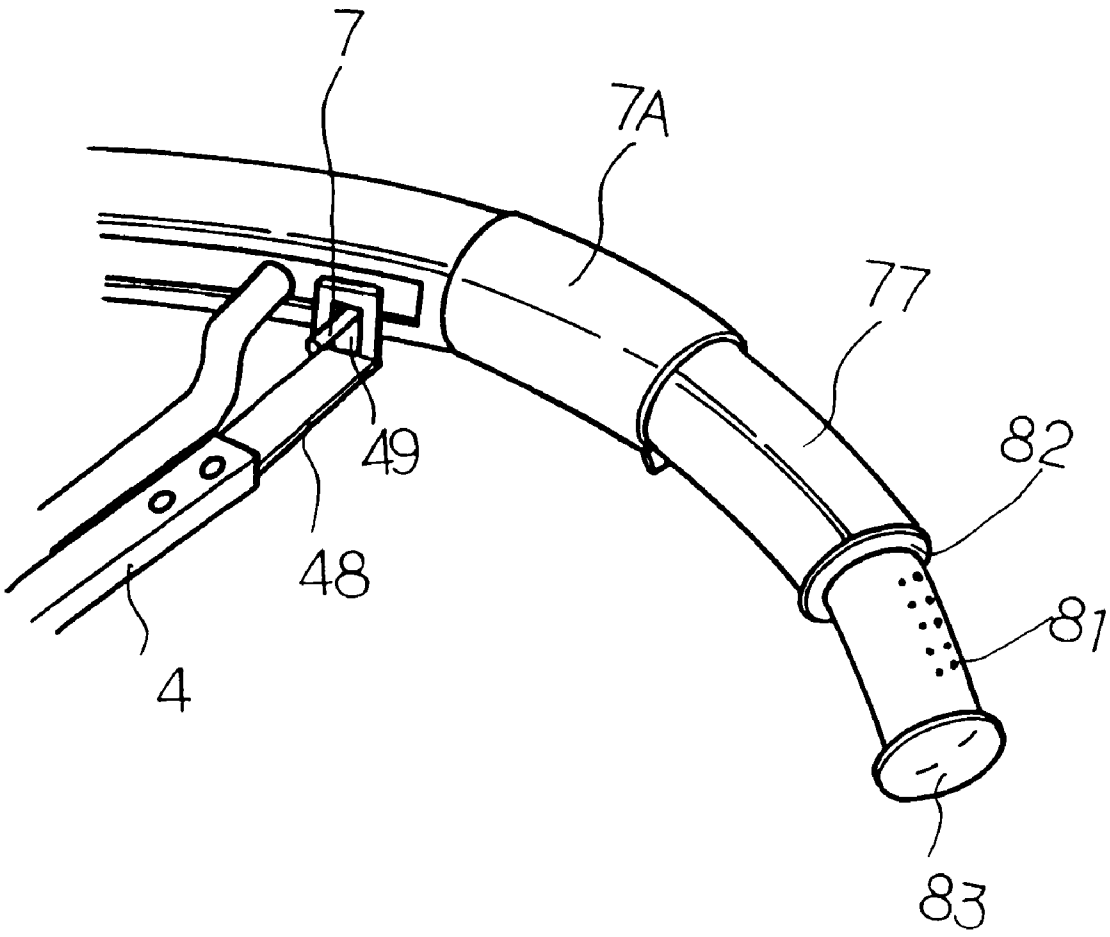
FIG. 14 shows a schematic view of a crank and the water ejecting tube of the present invention.
Figure 15:
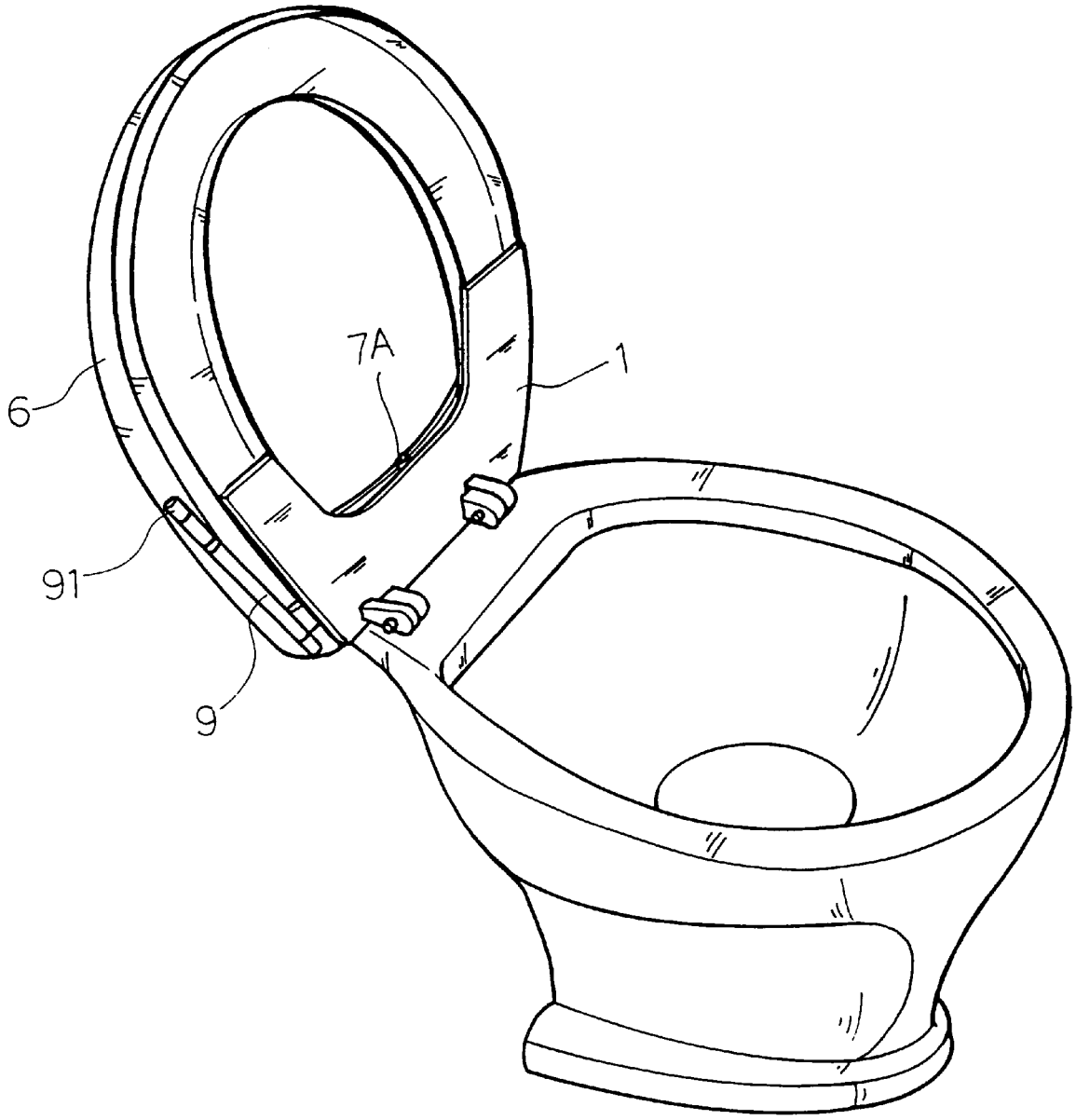
FIG. 15 is a schematic view showing that a toilet seat of the flush toilet of the present invention is lifted to remain apart from the toilet bowl.

The crank 4 of the present invention may be modified such that other end of the crank 4 is provided with a plate 48 having a framed hold 49 through which the fastening rod 7 is put. The water emitting tube 77 can be easily driven by the crank 4, in cooperation with the tension spring 72, to move back and forth. As a result, the water emitting tube 77 moves back and forth along with the crank 4, as shown in FIG. 14.

What is claimed is:

1. A toilet device for cleaning oneself after an evacuation of the bowels, said toilet device comprising a base fastened with an inner side of a rear end of a toilet seat, a crank fastened pivotally with said base such that said crank is fastened at one end thereof with a handle which is provided at one end thereof with a water switch fastened therewith, said handle further provided at other end thereof with a water inlet and a water outlet, said water inlet being in communication with a water admitting tube, said water outlet being in communication with a water discharging tube, said water switch being connected with a switching rod which is provided at one end thereof with a tapered body for regulating the amount of water that is admitted or discharged;

wherein said base is provided with a slide cover of an arcuate construction and fastened therewith, said base further provided with a water emitting tube of an arcuate construction, said water emitting tube being movably fitted into said slide cover and provided at one end thereof with a water inlet and a fastening rod fastened therewith, said water inlet of said emitting water tube being connected with said water discharging tube, said water emitting tube is further provided at other end thereof with a plurality of water emitting holes;

wherein said crank is provided at one end thereof with a rotary slide column having an oblong slot in which said fastening rod of said water emitting tube is disposed, said crank further provided with a hooked portion and a spring which is engaged at one end thereof with said hooked portion and at other end thereof with a protrusion of said base;

wherein said handle is activated such that said crank is actuated to drive said water emitting tube to extend along a radian of said slide cover such that said water emitting holes of said water emitting tube are positioned to clean the anus of a person seated on the toilet seat.

2. The toilet device as defined in claim 1, wherein said slide cover is provided at one end thereof with a cylindrical portion and at other end thereof with a pulley, said slide cover further provided at one side thereof with a tension spring fastened therewith such that said tension spring is fastened at one end thereof with a pull cord which is in turn fastened at other end thereof with said water emitting tube.

3. The toilet device as defined in claim 1, wherein said slide cover is provided at one end thereof with a water discharging port and a stop piece contiguous to said water discharging port.

4. The toilet device as defined in claim 1, wherein said water emitting tube is provided with a water emitting portion having a circular groove for locating a washer, said water emitting portion further having a sealing head and a connection head for connecting said pull cord.

5. The toilet device as defined in claim 1, wherein said crank is provided at other thereof with a plate having a framed hole; and wherein said water emitting tube is provided at one end thereof with a solid body having a threaded hole which is engaged with a threaded segment of a fastening rod, said fastening rod being put through said framed hole of said plate of said crank.

* * * * *